United States Patent [19]

Foshee et al.

[11] Patent Number: 4,813,254

[45] Date of Patent: Mar. 21, 1989

[54] BAR LOCK APPARATUS

[75] Inventors: William R. Foshee, Noblesville; Duane B. Nixon, Indianapolis, both of Ind.

[73] Assignee: Best Lock Corporation, Indianapolis, Ind.

[21] Appl. No.: 42,790

[22] Filed: Apr. 27, 1987

[51] Int. Cl.[4] ..... E05B 63/00

[52] U.S. Cl. ..... 70/104; 70/97; 70/160

[58] Field of Search ..... 70/97, 104, 85, 91, 70/101, 102, 360; 292/302

[56] References Cited

U.S. PATENT DOCUMENTS

| | | | |
|---|---|---|---|
| 3,711,894 | 1/1973 | Walters | 16/144 |
| 3,827,266 | 8/1974 | Walters | 70/104 |
| 3,899,905 | 8/1975 | Walters | 70/91 |
| 3,921,422 | 11/1975 | Walters | 70/97 |
| 3,940,957 | 3/1976 | Walters | 70/104 |
| 4,444,034 | 4/1984 | Best et al. | 70/369 |
| 4,655,063 | 4/1987 | Foshee et al. | 70/419 |

*Primary Examiner*—Robert L. Wolfe

*Attorney, Agent, or Firm*—Barnes & Thornburg

[57] ABSTRACT

A bar lock system includes first and second plates. Each plate includes lugs for mating with an adjacent plate. The first plate includes an inner wall defining an axial bore having opposite forward and rearward openings and the second plate includes an inner wall defining a bolt-receiving cup. The stop member extends a predetermined distance into the axial bore to provide a rearwardly presented blocking surface. A key-actuated bar lock mechanism is position within the axial bore of the first plate for sliding movement therein toward a second plate-locking position. The bar lock mechanism includes a bolt for entering the bolt-receiving cup upon movement of the bar lock mechanism to its second plate-locking position. The mechanism further includes a retainer assembly for selectively confining the stop member to limit sliding axial movement of the bar lock mechanism relative to the first plate in forward and rearward directions so that unauthorized removal of the bar lock mechanism from the axial bore is prevented. The lugs, bolt assembly, and retainer assembly cooperate to interlock the first and second plates, thereby preventing unauthorized separation thereof.

37 Claims, 3 Drawing Sheets

BAR LOCK APPARATUS

BACKGROUND AND SUMMARY OF THE INVENTION

The present invention relates to bar locking systems and, in particular, to a bar lock apparatus having a key-actuated high-security core. More particularly, the present invention relates to a bar lock apparatus having a bolt mechanism that is releasable for service or replacement by removing the high-security core from its mounted position within the bar lock apparatus.

Conventional bar lock assemblies include a pair of interengageable plates and a bar lock mechanism slidably received in a bore defined by the plates. It is known to use a hidden set screw to couple the bar lock mechanism to one of the plates, thereby limiting the range of axial movement of the slidable bar lock mechanism in the plate bore. See, for example, U.S. Pat. Nos. 3,827,266; 3,899,905; 3,921,422; and 3,940,957 to Walters.

It is necessary to operate the above-noted hidden set screw to permit removal of the bar lock mechanism from the plate bore for service or replacement. Since each known plate is typically bolted and welded to its underlying door panel or the like, it becomes a troublesome and often time-consuming problem to remove the welded plates from their mounted positions to gain access to the head of the hidden set screw. Such a problem typically exists for known bar lock assemblies each time it becomes necessary to service or replace the bar lock mechanism.

One object of the present invention is to provide a bar lock system configured to permit a service representative to remove the bar lock mechanism for service easily in the event that it malfunctions or requires cleaning without having to take the entire unit off the door.

Another object of the present invention is to provide a bar lock system wherein the slidable bar lock mechanism is key-actuated to permit removal of the bar lock mechanism for service solely by operation of a control key inserted into a core provided in the bar lock mechanism.

Yet another object of the present invention is to provide a key-actuated bar lock system which is conveniently modifable in the field to prevent removal of the operating key from the bar lock mechanism when the key is in the lock and the bar lock mechanism has been moved to an unlocked position.

In accordance with the present invention, a bar lock system is provided for lockably connecting two adjacent panels together. The bar lock system includes a pair of matable plates. One plate includes an inner wall defining an axial bore having opposite forward and rearward openings. A bar lock mechanism is positioned within the axial bore for sliding movement therein.

Retaining means is also provided in the bar lock system for releasably retaining at least a portion of the bar lock mechanism in the axial bore of the one plate. The retaining means operates to prevent unauthorized removal of the bar lock mechanism from the axial bore through the rearward opening. The retaining means moves within the axial bore in directions substantially parallel to the longitudinal axis of the axial bore between a retaining position obstructing removal of the bar lock mechanism from the axial bore and release positions.

In preferred embodiments of the present invention, the one plate includes stop means in its axial bore for blocking forward movement of the bar lock mechanism therein past a predetermined location following introduction of the bar lock mechanism into the axial bore through the rearward opening. Thus, the stop means operates to prevent unauthorized removal of the bar lock mechanism from the axial bore through the forward opening.

The one plate includes a rearward portion extending between the stop means and the rearward opening. The rearward portion is formed to include an F-shaped pin-receiving slot having an opening in the inner wall. In addition, the bar lock mechanism includes pin means for lockably engaging the pin-receiving slot to retain the bar lock mechanism in at least one selected position within the axial bore in said one plate.

The bar lock mechanism is formed to include a forwardly opening core-receiving chamber. The retaining means includes a lock core, a lock cap having an inner face, and means for mounting on the lock core. The lock core includes control-lug means for selectively retaining a portion of the lock core in the core-receiving chamber to position the inner face of the mounted lock cap in spaced-apart confronting relation to the stop means. In use, the inner face of the lock cap engages the stop means during rearward movement of the bar lock mechanism in the axial bore to prevent unauthorized removal of the bar lock mechanism from the axial bore through the rearward opening.

The stop means is rigidly fixed to the inner wall and extends into the axial bore a predetermined distance to provide a forwardly presented blocking surface for engaging the inner face of the lock cap. Thus, the stop means acts to define the predetermined location at which rearward movement of the bar lock mechanism in the axial bore is blocked.

The lock cylinder means includes an exterior side wall formed to include an aperture therein and the lock core includes a key-actuated rotatable key plug. The pin means includes throw member means for engaging the key plug, support means for rotatably mounting the throw member means in the lock cylinder means to rotate with the key plug, and a locking pin having a proximal end fixed to the throw member means and a distal end extending through the side wall aperture for engagement with the pin-receiving slot.

In one embodiment, the pin-receiving slot and the pin means are configured to prevent removal of an operating key from its operating position within the bar lock mechanism. In this embodiment, the F-shaped pin-receiving slot has a selected side branch formed to include a specially configured flanged side wall. That side wall is flanged to block entry of a wide cylindrical locking pin, thereby providing a barrier to rotation of the key plug and throw member means and preventing removal of the operating key from the key plug when the bar lock mechanism is in its unlocked position. In another embodiment, the locking pin has a stepped distal end configured to mate with the flanged side wall and enter the selected side branch upon rotation of the key plug, thereby allowing a user to remove the key from the key plug in either the locked or unlocked position of the bar lock mechanism.

One feature of the present invention is the provision of bar lock mechanism retaining means which is movable within the axial bore in directions substantially parallel to the longitudinal axis thereof. This feature advantageously enables a service representative to release the normally captive bar lock mechanism simply by moving the retaining means in an axial direction within the axial bore that does not require detachment of either one of the plates from its door panel. Avoidance of such a detachment step during each service call advantageously lessens risk of damage to the plates and to the bar lock mechanism itself, reduces service time, simplifies service operations, minimizes inventories of replacement plates and related hardware typically needed to replace damaged components, and lessens overall costs of service.

Another feature of the present invention is the inclusion of a lock core in the retaining means having a lock cap and control-lug means for retainably positioning the lock cap in spaced-apart confronting relation to the stop means. Advantageously, the lock cap engages the stop means during withdrawal of the bar lock mechanism through the rearward opening, thereby blocking unauthorized removal. In addition, such locking cap "blocking means" is easily disabled by using a control key to operate the control-lug means and remove the lock core from its mounted position within the bar lock mechanism. Such a feature is a significant improvement over conventional retaining means of the type described above which generally require operation of a difficult-to-access hidden set screw to effect the release of a bar lock mechanism for service or replacement.

Yet another feature of the present invention is the configuration of the F-shaped pin-receiving slot to include a flanged side branch for controlling the operation of the locking pin. In one embodiment, the locking pin has a stepped distal end configured to slide into and engage the flanged side branch to permit removal of the operating key from the key plug when the bar lock mechanism is in its unlocked position. Alternatively, in another embodiment, the locking pin has a wide distal end that is too large to be inserted into the flanged side branch, thereby preventing removal of the operating key from the key plug when the bar lock mechanism is in its unlocked position. Advantageously, merely by replacement of the locking pin, the bar locking system of the present invention is adaptable either to permit or prevent removal of the lock-operating key when the bar lock mechanism is in its unlocked position. This feature enhances the key control and operational versatility of the improved system.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
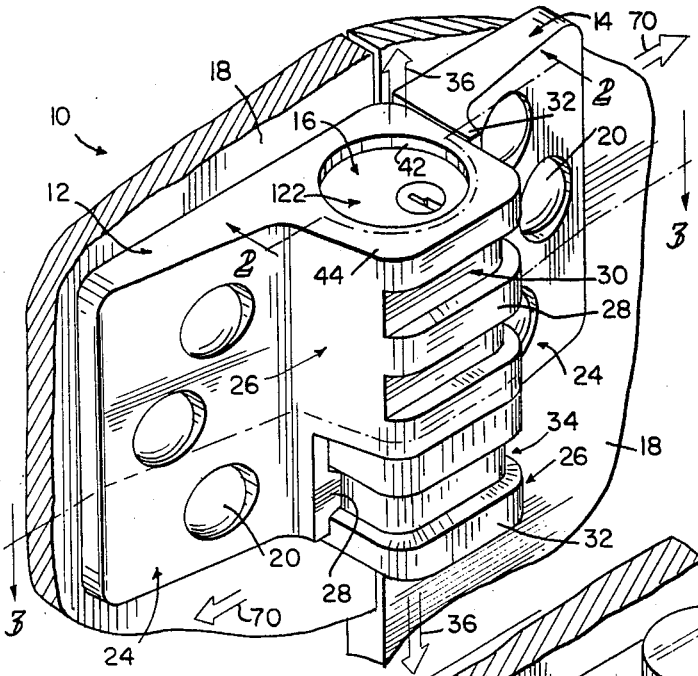
FIG. 1 is a perspective view of a bar lock assembly according to the present invention illustrating a first mounting orientation and showing the interengaged plates mounted on door panels and the bar lock mechanism retained in its locking position to prevent unauthorized separation of the plates.

Each bar lock system 10 includes a pair of complementary plates 12, 14 and a latching bar lock mechanism 16. Plate 12 provides a latch-housing means while plate 14 provides a latch-receiver means. Each plate 12, 14 is mountable on a door panel 18 using bolt means 20 and may be welded in place to improve the security of system 10. The bar lock system 10 is shown mounted in its top-access actuating orientation in FIGS. 1–5 wherein the key opening is presented in an upward direction and in an alternative bottom-access actuating orientation in FIGS. 10, 12, and 13 wherein the key opening is presented in a downward direction. As seen best in FIG. 2, the plates 12, 14 cooperate to define means for slidably receiving bar lock mechanism 16 therein for movement between a locking position shown in FIG. 1 and an unlocking "release" position shown in FIG. 4.

Figure 2:
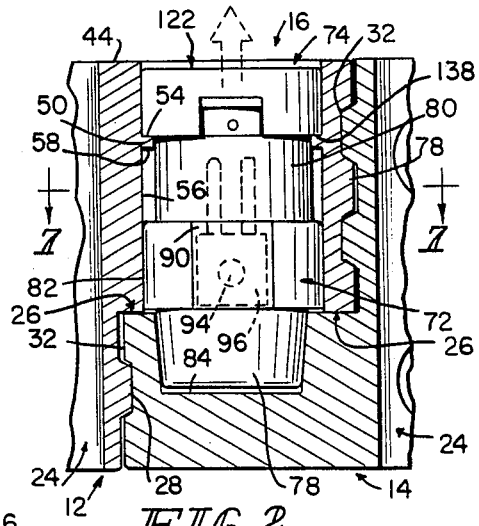
FIG. 2 is a transverse sectional view of the apparatus i in FIG. 1 taken along lines 2—2 of FIG. 1.
Figure 4:
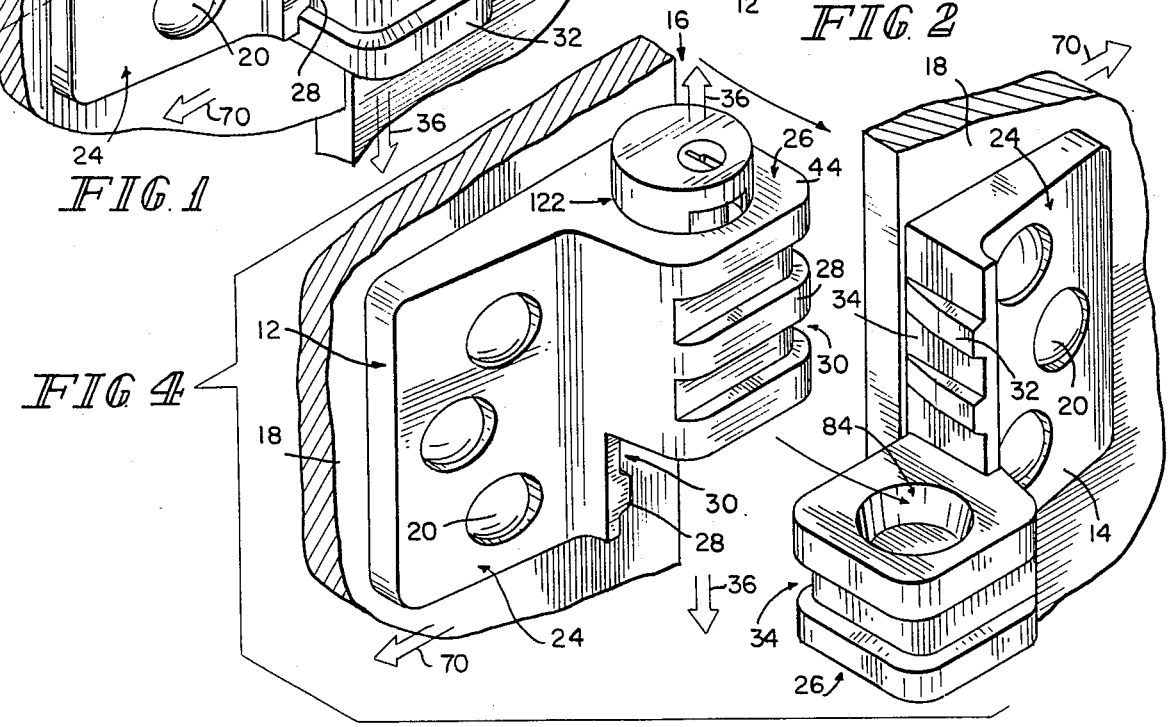
FIG. 4 is a perspective view of the embodiment illustrated in FIG. 1 showing the two plates in a separated position.

As shown best in FIGS. 1 and 4, each plate 12, 14 includes a mounting member 24 and an integral lug member 26. The mounting and lug members 24, 26 of the latch-housing plate 12 include a plurality of mating elements 28 and channels 30 for interengaging corresponding mating elements 32 and channels 34 provided on the latch-receiver plate 14 in a "tooth-in-groove"

manner known in the art. Reference is hereby made to U.S. Pat. Nos. 3,940,957 and 3,921,422 to Walters for complete descriptions of tooth-in-groove means for interlocking plate assemblies suitable for use in the present invention.

When interengaged, the companion Plates 12, 14 are coupled to resist axial separation in the direction of double arrows 36. It will be appreciated that mating elements 28, 32 and channels 30, 34 are configured to permit interlocking of plates 12, 14 in a variety of angular orientations so that the system 10 is adaptable for use as an "inside corner" or "outside corner" mount (not shown) as well as a "flat" mount (shown in FIGS. 1 and 3).

Figure 5:
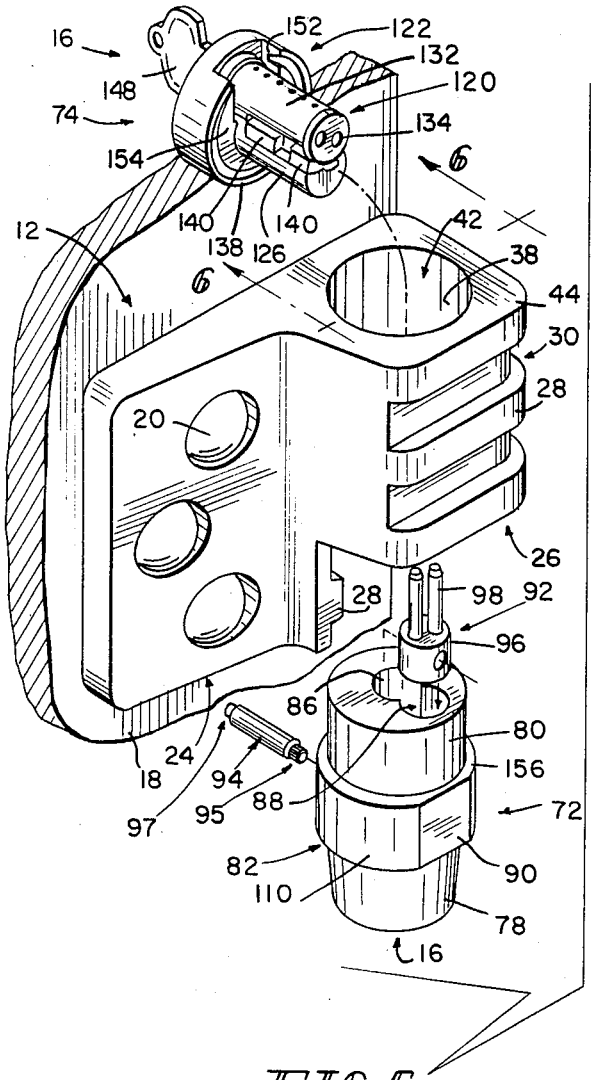
FIG. 5 is a perspective exploded assembly view of the latch-housing plate demonstrating assembly of the bar lock mechanism into an axial bore formed therein.
Figure 6:
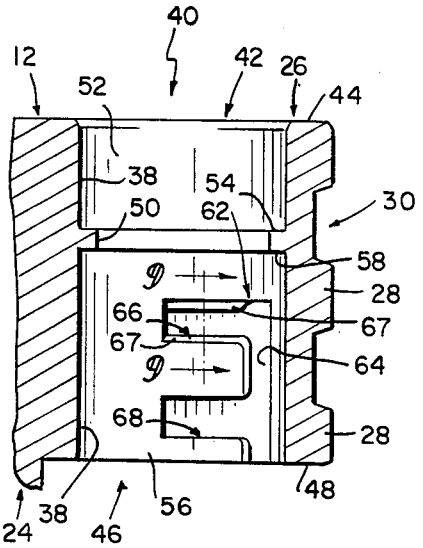
FIG. 6 is a transverse sectional view of the empty latch-housing plate illustrated in FIG. 5 taken along lines 6—6 of FIG. 5.

Referring primarily to FIGS. 5 and 6, the lug member 26 of the latch-housing plate 12 includes an inner wall 38 defining an axial bore 40. Axial bore 40 has a forward opening 42 in its front face 44 and a rearward opening 46 in its back face 48. A circular flange 50 is provided to partition the axial bore 40 into a forward portion 52 extending between a forwardly presented face 54 of circular flange 50 and forward opening 42, and a rearward portion 56 extending between a rearwardly presented face 58 of circular flange 50 and rearward opening 46. Circular flange 50 is integral with inner wall 38 and extends in a radially inward direction into axial bore 40 to provide the forwardly and rearwardly presented faces 54 and 58.

The rearward portion 56 is formed to include an F-shaped pin-receiving slot 62 having an opening in inner wall 38. The F-shaped slot 62 provides a neutral passage 64 extending from the rearward opening 46 toward circular flange 50, a first side branch 66 in proximity to circular flange 50, and a second side branch 68 intermediate the first side branch 60 and the rearward opening 46. The first side branch 66 desirably includes a pair of opposing, inwardly extending flanges 67 as shown best in FIGS. 6 and 9. Circular flange 50 and F-shaped slot 62 cooperate to aid in retaining bar lock mechanism 16 in either its locking or unlocking position in the manner to be described below.

The bar lock mechanism 16 is operable to prevent transverse separation of the companion plates 12, 14 in the direction of double arrows 70. Thus, bar lock mechanism 16 cooperates with the matable means 28, 30, 32, 34 to interlock the plates 12, 14 in fixed relation so that the door panels 18 are locked together. The bar lock mechanism 16 includes an actuator assembly 72 and a separate key-actuator retainer assembly 74 configured to selectively engage the actuator assembly 72, thereby enabling a user to interconnect the assemblies 72, 74 in a predetermined position in the axial bore 40 illustratively shown in FIG. 2. This interconnection effectively locks the interengaged plates 12, 14 to prevent separation thereof.

Figure 8:
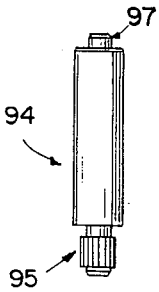
FIG. 8 is an enlarged side view of the first embodiment of the locking pin showing its "stepped" distal end.

Actuator assembly 72 illustratively includes a bolt portion 78, a lock cylinder portion 80, and a wide circumferential flange 82 situated therebetween. Bolt portion 78 is sized and shaped to mate with a bolt-receiving cup 84 formed in the lug member 26 of the latch-receiver plate 14 as seen best in FIG. 2. At an opposite end, the lock cylinder portion 80 is formed to include an inner wall 86 defining a figure-8-shaped core-receiving chamber 88 for receiving a portion of the retainer assembly 74. Flange 72 is provided with a flat side wall 90 that is matable with a corresponding flat portion (not shown) in the inner wall 38 of the latch-housing plate 12 to orient the actuator assembly 72 in the axial bore 40 properly.

Figure 13:
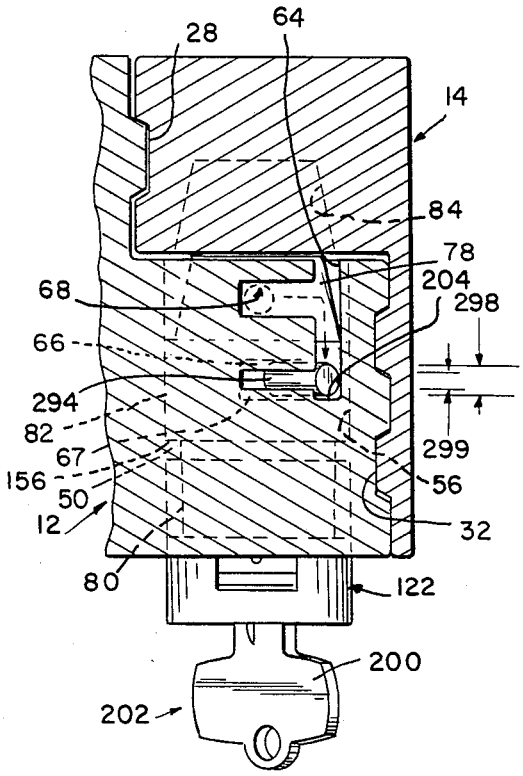
FIG. 13 is a transverse sectional view taken along lines 13—13 of FIG. 12 showing a portion of the apparatus of FIG. 10 following movement of the bar lock mechanism to release position and illustrating the orientation of the key in its "blocked" position.
Figure 11:
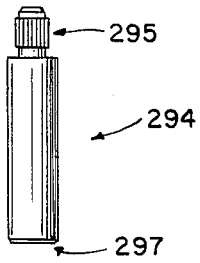
FIG. 11 is a side view of a second embodiment of the locking pin showing its "non-stepped" distal end.
Figure 12:
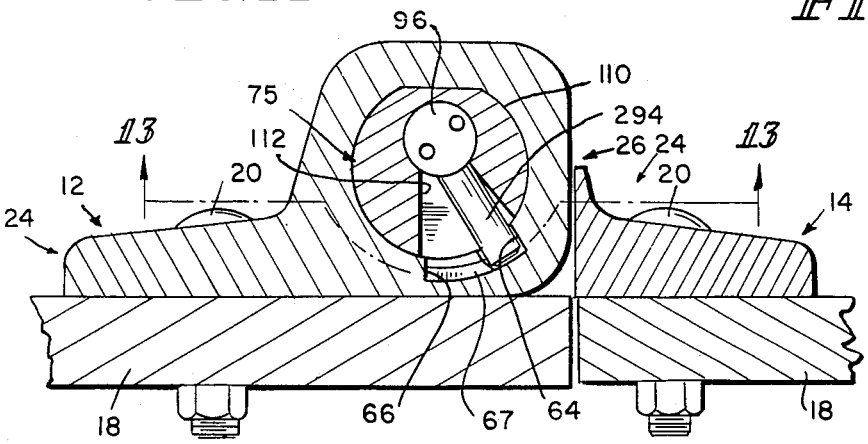
FIG. 12 is a transverse sectional view taken along lines 12—12 of FIG. 10, showing the "non-stepped" distal end of the second embodiment of the locking pin blocked at the entrance of the side leg corresponding to the release position of the bar lock mechanism, thereby preventing a user from withdrawing the key when the bar lock mechanism is in its release position.

A pin assembly is rotatably mounted in an interior region provided in circumferential flange 82 so as to communicate with both the core-receiving chamber 88 and, when the actuator assembly 72 is mounted in the rearward portion 56 of the latch-housing plate 12, the F-shaped pin-receiving slot 62. Two embodiments of locking pins suitable for operation in slot 62 are provided to enhance the versatility of bar lock system 10. A first embodiment (94) illustrated in FIGS. 3, 5, 8, and 9 is configured to engage the flanged first side branch 66 upon rotation of the pin assembly, thereby permitting a user to rotate the key to a position in which the key may be withdrawn from its lock core when the bolt portion 78 has been moved to its unlocked position as shown in FIG. 4. A second embodiment (294) illustrated in FIGS. 11–13 is configured to be blocked from engaging the first side branch 66 by flange 67 when bolt portion 78 has been moved to its unlocked position as shown in FIGS. 12 and 13. Thus, the second embodiment (294) is selected to prevent a user from rotating the key to a withdrawal position upon unlocking the bar lock system 10.

The pin assembly includes a throw member 92 and a hardened locking pin 94 as seen best in FIG. 5. The throw member 42 includes a head 96 and a pair of axially extending throw pins 98 fixed to the head 96 in spaced-apart parallel relation. The locking pin 94 includes a proximal end 95 rigidly connected to head 96 and an opposite distal end 97. The distal end 97 of this first locking pin embodiment (94) is configured to engage the T-shaped groove formed in first side branch 66 by flange 67. Thus, stepped locking pin 94 is freely movable within branch 66 upon rotation of throw member 92.

Figure 3:
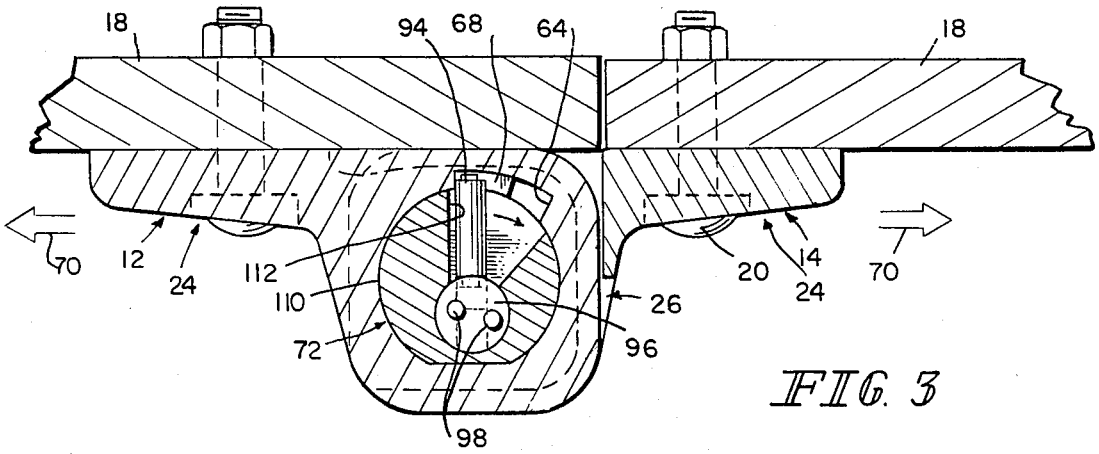
FIG. 3 is a transverse sectional view of the system illustrated in FIG. 1 taken along lines 3—3 of FIG. 1, showing a first embodiment of the locking pin positioned in a locking position in one side leg of the F-shaped pin-receiving slot.

The circumferential flange 82 includes an annular exterior surface 110 formed to include a fan-shaped aperture 112 as shown in FIG. 3. The head 96 is rotatably journaled in the interior region of flange 82 to extend the throw pins 98 into the core-receiving chamber 88 and to extend the distal end of the pivoting stepped locking pin 94 through the fan-shaped aperture 112 for engagement with the F-shaped pin-receiving slot 62. Desirably, the axis of rotation of head 96 is offset a predetermined amount relative to the longitudinal axis of the bar lock mechanism 16 as shown best in FIG. 3.

Figure 7:
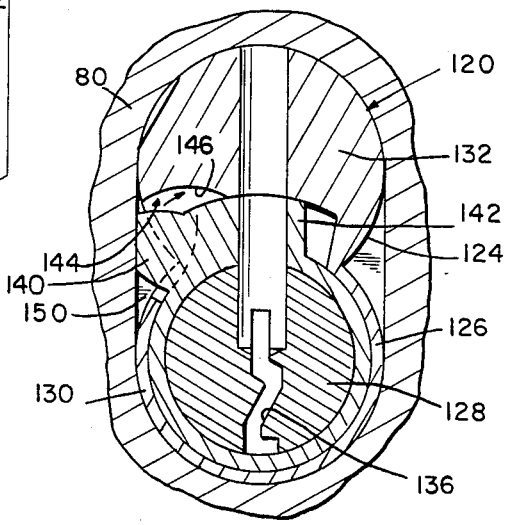
FIG. 7 is an enlarged, transverse sectional view of a lock core in the bar lock mechanism taken along lines 7—7 of FIG. 2.

Retainer assembly 74 is best seen in FIGS. 5 and 7, and illustratively includes an interchangeable core 120 and a cylinder cap 122. The interchangeable core 120 includes a core body 124 that is desirably of figure-8 cross-section. The core body 124 has a lower lobe 126 which contains a rotatable key plug 128 and a core sleeve 130 (see FIG. 7), and an upper lobe 132 which contains pin tumblers or segments. The key plug 128 is formed with an axial broached key slot 136 and is rotatably mounted within the core sleeve 130. Throw pins 98 are adapted to be received in a corresponding pair of holes 134 provided in the inner end of the key plug 128 to transmit key plug rotation to the head 96, thereby pivoting stepped locking pin 94 about the axis of rotation of head 96.

Illustratively, a pair of control lugs 140 are carried on a wide rib 142 of sleeve 130 as shown in FIG. 7. Each control lug 140 projects through a side groove 144 of the figure-8-shaped core body 124. In a lug-projected position illustrated in FIGS. 5 and 7, the control lugs 140 engage radially inwardly extending ribs 150 fixed to the inner wall 86 of the core-receiving chamber 88 to retain the interchangeable core 120 in a predetermined position within the lock cylinder portion 80. Also as shown in FIG. 7, the upper lobe 132 is formed with a recess 146 into which the control lugs 140 move when the sleeve 130 is rotated by control key 148 from its lug-projected position to its lug-retracting position (not shown). Reference is hereby made to U.S. Pat. No. 4,444,034 to Best et al for a complete description of interchangeable cores suitable for use in the present invention.

Cylinder cap 122 has a cavity 152 which is slidably engageable with a tranverse slot (not shown) formed in the upper lobe 132 of the interchangeable core 120. Cylinder cap 122 includes a rearwardly presented surface 154 surrounding the core body 124 as seen best in FIG. 5. Reference is hereby made to U.S. patent application Ser. No. 06/718,538 filed Apr. 1, 1985 for a complete description of a cap/interchangeable assembly suitable for use in the present invention.

Bar lock mechanism 16 is installed in the axial bore 40 of the latch-housing plate 12 in the following manner. Actuator assembly 72 is installed by positioning the lock cylinder portion 80 in close proximity to the rearward opening 46 of the axial bore 40. The actuator assembly 72 is rotated about its longitudinal axis to align flat side wall 90 of flange 82 with the corresponding flat portion (not shown) of inner wall 38. The stepped locking pin 94 is pivoted to a position in alignment with the entrance of neutral passage 64 in the pin-receiving slot 62. Such alignment permits a service representative to move the actuator assembly 72 completely into the rearward portion 56 of the axial bore 40. At this stage, the stepped locking pin 94 is positioned in the neutral passage 64 at the mouth of the flanged first side branch 66 and throw pins 98 are oriented in a predetermined position to be received in holes 134 of key plug 128 upon movement of interchangeable core 120 into the forwardly opening core-receiving chamber 88. In addition, a forwardly presented circumferentially extending edge 156 of flange 82 has been moved to abut the rearwardly presented face 58 of circular flange 50 to block continued forward movement of bar lock mechanism 16 in the axial bore 40.

Prior to installation of retainer assembly 74, control key 148 is used to move control lugs 140 to a retracted position (not shown) to permit introduction of core 120 into the core-receiving chamber 88. Movement of the control lugs 140 to such a retracted position permits the lugs 140 to clear ribs 150 provided on the inner wall 86 of the lock cylinder portion 80. At this stage, the actuator assembly 72 and the retainer assembly 74 are interlocked by using control key 148 to move the control lugs 140 to the lug-retaining positions illustrated in FIG. 7 and then withdrawing the control key 148. In this position, a cylinder cap 122 extends a slight distance out of the axial bore 40 as shown in FIG. 4.

Stepped locking pin 94 is movable in the F-shaped slot by using a separate operating key (not shown) in the conventional way to permit movement of the bar lock mechanism 16 between the retracted position shown in FIG. 4 and the locking projected position shown in FIG. 1. In this installed position, the rearwardly presented surface 154 of cylinder cap 122, the forwardly presented edge 156 of flange 82, the circular flange 50 confined between surface 154 and edge 156, and the interaction between stepped locking pin 94 and F-shaped pin-receiving slot 62 cooperate to retain the bar lock mechanism 16 in one of its retracted and projected positions, yet permit the bar lock mechanism 16 to slide between said two positions.

Figure 9:
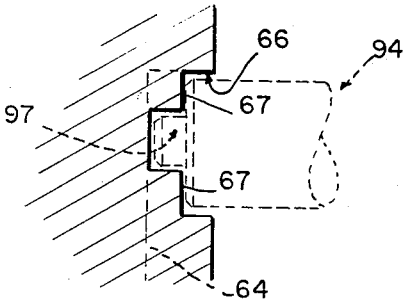
FIG. 9 is an enlarged sectional view taken along lines 9—9 of FIG. 6 showing engagement of the "stepped" distal end of the locking pin of FIG. 8 in the other side leg of the F-shaped pin-receiving slot, thereby permitting a user to withdraw the key when the bar lock mechanism in its unlocked release position.

In the unlocked position illustrated in FIG. 4, forward movement of the bar lock mechanism 16 is blocked by engagement of the stepped locking pin 94 in the flanged first side branch 66 of the F-shaped slot 62 and also by engagement of the forwardly presented edge 156 of the flange 82 and the rearwardly presented face 58 of circular flange 50. In addition, rearward movement of the unlocked bar lock mechanism 16 is blocked by engagement of the stepped locking pin 94 in the flanged first side branch 66 of the F-shaped slot 62. Engagement of pin 94 in branch 66 is best seen in FIG. 9.

In the locked position illustrated in FIG. 1, rearward movement of the bar lock mechanism 16 is blocked by engagement of stepped locking pin 94 in the second side branch 68 of the F-shaped slot 62 and by engagement of the rearwardly presented surface 154 of the cylinder cap 122 and the forwardly presented surface 54 of circular flange 50. In addition, forward movement of the locked bar lock mechanism 16 is blocked by engagement of stepped locking pin 94 in the second side branch 68 of the F-shaped slot 62.

Locking pin 294 illustrated in FIGS. 11–13 represents a second embodiment of a pin suitable for use in the pin assembly of bar lock system 10. Pin 294 includes proximal end 295 for mounting in the head 96 of throw member 92 and distal end 297. Importantly, distal end 295 has a width dimension 298 greater than the dimension 299 extending between opposed flanges 67 as shown in FIG. 13. This configuration effectively blocks non-stepped locking pin 294 at the mouth of first side branch 66 to prevent movement of pin 294 into branch 66. Such blockage prevents a user from rotating the bow 200 of operating key 202 in a clockwise direction (FIG. 12) when the bolt member 78 has been moved to its unlocked position as shown in FIG. 13.

Figure 10:
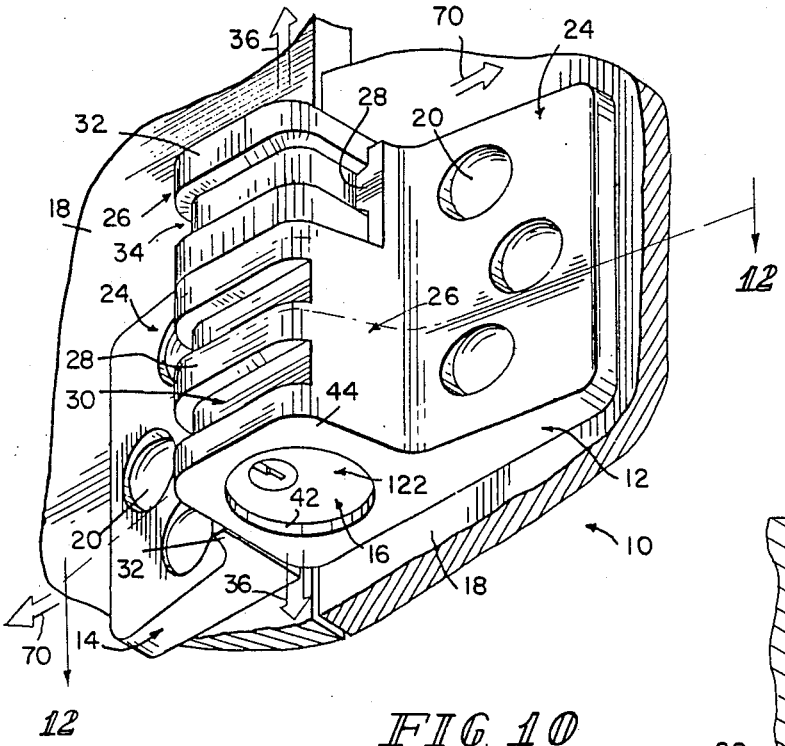
FIG. 10 is a perspective view of bar lock assembly similar to that illustrated in FIG. 1 but mounted in an inverted position to present the key slot in a downward direction, thereby illustrating a second mounting orientation.

Preferably, bar lock system 10 is mounted in the orientation illustrated in FIG. 10 whenever locking pin 294 is installed therein. As shown in FIG. 13, either the forwardly presented edge 156 of flange 82 can engage flange 50 or the distal end 297 of pin 294 can engage wall 204 at the end of neutral passage 64 to support the entire bar lock mechanism 72 in the illustrated unlocked position. Advantageously, such an arrangement enables a user to interengage plates 12 and 14 without manipulating the axial position of bar lock mechanism 72.

It will be appreciated that the alternative orientation of system 10 illustrated in FIG. 1 will function satisfactorily using non-stepped locking pin 294 as long as the user lifts bar lock mechanism 72 upwardly during engagement of the plates to permit engagement of bolt member 78 in cup 84. The orientation of system 10 is of less concern when stepped locking pin 94 is used since pin 94 can be positioned in the first side branch 66 as shown in FIG. 9 upon movement of the bolt member 78 to its unlocked position. Thus, either one of flanges 67 can operate to provide means for supporting the bar lock mechanism 72 in a retracted position within lug member 26 so the bolt member 78 does not interfere with the engagement of plates 12 and 14.

Although the invention has been described in detail with reference to certain preferred embodiments, variations and modifications exist within the scope and spirit of the invention as described and defined in the following claims.

What is claimed is:

1. A bar lock system comprising a pair of matable plates, one of the plates including an inner wall defining an axial bore having opposite forward and rearward openings, a bar lock mechanism positioned within the axial bore for sliding movement therein, and retaining means for releasably retaining at least a portion of the bar lock mechanism in the axial bore of the one plate to prevent unauthorized removal of the bar lock mechanism from the axial bore through the rearward opening, the retaining means moving within the axial bore in directions substantially parallel to the longitudinal axis of the axial bore between a retaining position obstructing removal of the bar lock mechanism from the axial bore and release positions.

2. The bar lock system of claim 1, wherein the bar lock mechanism includes bolt means for selectively entering an axial bore formed in the companion other plate and lock cylinder means for engaging the inner wall of said one plate to control the axial position of the bar lock mechanism in the axial bore of said one plate, the retaining means includes interlock means for releasably engaging the lock cylinder means to interconnect the retaining means and the lock cylinder means, and the interlock means is situated in radially inward spaced-apart relation to the inner wall of said one plate during movement between engaged and disengaged positions.

3. The bar lock system of claim 1, wherein the retaining means is positioned wholly within a region defined by the axial bore of said one plate during movement between its retaining and release positions.

4. The bar lock system of claim 3, wherein said one plate is configured to include a barrier fixed to the inner wall and the barrier extends in a radially inward direction into the axial bore to provide stop means for engaging the retaining means at a predetermined location along the length of the axial bore during rearward movement of the retaining means in the axial bore toward its retaining position.

5. The bar lock system of claim 1, wherein the bar lock mechanism includes a front portion and a rear portion, the front portion has a front face and an interior wall defining a chamber having an opening in the front face, and the retaining means includes interlock means for selectively engaging the interior wall of the front portion to couple the retaining means to the bar lock mechanism.

6. The bar lock system of claim 5, wherein the front portion is situated in proximity to the forward opening of the axial bore upon movement of the bar lock mechanism to a retained position to permit introduction of the interlock means into the chamber through the forward opening of the axial bore.

7. The bar lock mechanism of claim 5, wherein the interior wall is configured to provide at least one rib extending into the chamber, and the interlock means includes at least one control lug and control means for selectively moving the at least one control lug between an engaged position contacting the at least one rib obstructing separation of the bar lock mechanism and the retaining means and a disengaged position away from the at least one rib permitting separation of the bar lock mechanism and the retaining means.

8. The bar lock mechanism of claim 5, wherein said one plate includes stop means fixed in its axial bore for blocking forward movement of the bar lock mechanism therein past a predetermined location following introduction of the bar lock mechanism into the axial bore through the rearward opening and the retaining means further includes blocking means for engaging the stop means during movement of the bar lock mechanism in the axial bore toward a release position to prevent unauthorized removal of the bar lock mechanism from the axial bore through the rearward opening.

9. The bar lock system of claim 8, wherein the retaining means has a longitudinal axis, the interlock means is situated a first distance in radially spaced-apart relation to the longitudinal axis upon engagement of the interlock means and the interior wall of the front portion, and the blocking means includes a rearwardly presented blocking face having a perimeter situated a relatively greater second distance in radially spaced-apart relation to the longitudinal axis.

10. A bar lock system comprising a pair of matable plates, one of the plates including an inner wall defining an axial bore having opposite forward and rearward openings, a bar lock mechanism positioned within the axial bore for sliding movement therein, the bar lock mechanism being formed to include a core-receiving chamber, and retaining means for releasably retaining at least a portion of the bar lock mechanism in the axial bore of the one plate to prevent unauthorized removal of the bar lock mechanism from the axial bore through the rearward opening, the retaining means moving within the axial bore in directions substantially parallel to the longitudinal axis of the axial bore between a retaining position obstructing removal of the bar lock mechanism from the axial bore and release positions, said one Plate including stop means in its axial bore for blocking forward movement of the bar lock mechanism therein past a predetermined location following introduction of the bar lock mechanism into the axial bore through the rearward opening, the retaining means including a lock core, a lock cap having an inner face, and means for mounting on the lock core, the lock core including control lug means for selectively retaining a portion of the lock core in the core-receiving chamber of the bar lock mechanism to position the inner face of the mounted lock cap in spaced-apart confronting relation to the stop means so that the inner face of the lock cap engages the stop means during rearward movement of the bar lock mechanism in the axial bore to prevent unauthorized removal of the bar lock mechanism from the axial bore through the rearward opening.

11. The bar lock system of claim 10, wherein the stop means is rigidly fixed to the inner wall and extends into the axial bore a predetermined distance to provide a forwardly presented blocking surface for engaging the inner face of the lock cap, thereby defining said predetermined location.

12. The bar lock system of claim 10, wherein said one plate includes a rearward portion extending between the stop means and the rearward opening, the rearward portion is formed to include a pin-receiving slot having an opening in the inner wall, and the bar lock mechanism includes pin means for lockably engaging the pin-receiving slot to retain the bar lock mechanism in at least one selected position within the axial bore in said one plate.

13. The bar lock system of claim 12, wherein the lock cylinder means includes an exterior side wall formed to include an aperture therein, the lock core includes a key-actuated rotatable key plug, and the pin means includes throw member means for engaging the key plug, support means for rotatably mounting the throw member means in the lock cylinder means to rotate with the key plug, and a locking pin having a proximal end fixed to the throw member means and a distal end extending through the side wall aperture for engagement with the pin-receiving slot.

14. The bar lock mechanism of claim 13, wherein the pin-receiving slot is F-shaped to provide a main channel having a locking pin-receiving opening at the rearward opening of the axial plate bore and first and second side channels for selectively receiving the locking pin, one of the side channels including flange means for blocking movement of the distal end of the locking pin from the main channel into said one of the side channels to prevent removal of an operating key from the key plug upon axial movement of the lock core to a position corresponding to the release position of the retaining means.

15. A bar lock system comprising a pair of plates, one of the plates including an inner wall defining an axial bore having opposite forward and rearward openings, a bar lock mechanism positioned within the axial bore for sliding movement therein, and stop means for blocking forward movement of the bar lock mechanism in the axial bore at a predetermined location therein following introduction of the bar lock mechanism into the axial bore through the rearward opening to prevent unauthorized removal of the bar lock mechanism from the axial bore through the forward opening, the stop means being rigidly fixed to the inner wall and extending into the axial bore a predetermined distance to provide a rearwardly presented blocking surface for engaging the movable bar lock mechanism, thereby defining said predetermined location.

16. The bar lock system of claim 15, wherein the bar lock mechanism includes a blocking flange having a maximum outer dimension substantially equivalent to the inner diameter of the axial bore in said one plate and the blocking flange includes a forwardly presented surface configured to abut the rearwardly presented blocking surface of the stop means.

17. The bar lock system of claim 16, wherein said one plate is formed to include a pin-receiving slot having an opening in the inner wall, the blocking flange includes a side wall configured to slidably engage the inner wall, the side wall is formed to include an aperture therein, and the bar lock mechanism includes pin means extending through the side wall aperture for lockably engaging the pin-receiving slot.

18. The bar lock system of claim 17, wherein the bar lock mechanism includes a key-actuated rotatable key plug and the pin means includes throw member means for engaging the key plug, support means for rotatably mounting the throw member means in the bar lock mechanism to rotate with the key plug, and a locking pin having a proximal end fixed to the throw member means and a distal end extending through the side wall aperture for engagement with the pin-receiving slot.

19. The bar lock system of claim 16, wherein one plate is formed to include a pin-receiving slot having an opening in its inner wall and the bar lock mechanism includes bolt means for selectively entering an axial bore formed in an adjacent Plate in response to movement of the bar lock mechanism in a rearward direction away from said predetermined location and pin means for lockably engaging the pin-receiving slot to retain the bolt means in a locking position entering said axial bore in the adjacent plate.

20. The bar lock system of claim 19, wherein the bar lock mechanism includes a key-actuated rotatable key plug and the pin means includes throw member means for engaging the key plug, support means for rotatably mounting the throw member means in the bar lock mechanism to rotate with the key plug, and a locking pin having a proximal end fixed to the throw member means and a distal end extending through the side wall aperture for engagement with the pin-receiving slot.

21. The bar lock system of claim 15, wherein said one plate includes a rearward portion extending between the stop means and the rearward opening, the rearward portion is formed to include a pin-receiving slot having an opening in the inner wall, and the bar lock mechanism includes pin means for lockably engaging the pin-receiving slot.

22. The bar lock system of claim 21, wherein the stop means includes an arcuate side wall for slidably engaging the inner wall in the rearward portion, the arcuate side wall is formed to include an aperture therein, and the pin means is configured to extend through the arcuate side wall aperture.

23. The bar lock system of claim 22, wherein the bar lock mechanism includes a key-actuated rotatable key plug and the pin means includes throw member means for engaging the key plug, support means for rotatably mounting the throw member means in the bar lock mechanism to rotate with the key plug, and a locking pin having a proximal end fixed to the throw member means and a distal end extending through the side wall aperture for engagement with the pin-receiving slot.

24. The bar lock system of claim 15, wherein the bar lock mechanism includes abutment means for engaging the rearwardly presented blocking surface of the stop means, bolt means for selectively entering an axial bore formed in an adjacent plate, and locking means intermediate the abutment means and the bolt means for selectively retaining the bolt means in a locking position entering said axial bore in the companion other plate.

25. The bar lock system of claim 24, wherein said one plate is formed to include a pin-receiving slot having an opening in its inner wall and the locking means includes a locking pin for lockably engaging the pin-receiving slot.

26. The bar lock system of claim 25, wherein said one plate includes a rearward portion extending between the stop means and the rearward opening and the rearward portion is formed to include said pin-receiving slot.

27. The bar lock system of claim 15, wherein the bar lock mechanism includes locking means for selectively retaining the bar lock mechanism in at least one predetermined position within the axial bore, lock cylinder means for actuating the locking means, the lock cylinder means including a forwardmost face situated in spaced-apart relation to the locking means, and abutment means intermediate the locking means and the forwardmost face for engaging the rearwardly presented blocking surface of the stop means.

28. The bar lock system of claim 27, wherein said one plate is formed to include a pin-receiving slot having an opening in its inner wall and the locking means includes a locking pin for lockably engaging the pin-receiving slot.

29. The bar lock system of claim 28, wherein said one plate includes a rearward portion extending between the stop means and the rearward opening and the rearward portion is formed to include said pin-receiving slot.

30. A bar lock system comprising a pair of matable plates, one of the plates including an inner wall defining an axial bore having opposite forward and rearward openings, a bar lock mechanism positioned within the axial bore for sliding movement therein, the bar lock mechanism including means for blocking forward movement of the bar lock mechanism in the axial bore at a predetermined location following introduction of the bar lock mechanism into the axial bore through the rearward opening to prevent unauthorized removal of the bar lock mechanism from the axial bore through the forward opening, and retaining means for releasably retaining at least a portion of the bar lock mechanism in the axial bore to prevent unauthorized removal of the bar lock mechanism from the axial bore through the rearward opening, the retaining means being moved away from the bar lock mechanism in a direction substantially parallel to the longitudinal axis of the axial bore upon said release, thereby permitting selective removal of the bar lock mechanism from the axial bore through the rearward opening.

31. The bar lock system of claim 30, wherein the retaining means includes a locking pin having a proximal end pivotly connected to the bar lock mechanism and a distal end extending away from the bar lock mechanism, said one of the plates is formed to include an F-shaped pin-receiving slot having an F-shaped opening in the inner wall, the F-shaped slot provides an axially extending main channel and first and second transversely extending side channels communicating with the main channel, one of the side channels having a pair of side walls spaced apart to define a primary pin-receiving groove having a first width and a pair of inwardly extending opposed flanges positioned to define a secondary pin-receiving groove having a relatively narrower second width, the side walls and flanges cooperating to define a T-shaped passage in said one of the side channels, and the distal end of the locking pin is configured to provide one of a member having a width that is greater than said second width to prevent entry of the locking pin into said one of the side channels and a member having a T-shaped cross section selected to permit entry of the locking pin into said one of the side channels upon selected pivotal movement of the locking pin relative to the bar lock mechanism.

32. A bar lock system comprising first and second plates, each plate including lug means for mating with an adjacent plate, the first plate including an inner wall defining an axial bore having opposite forward and rearward openings and a stop member rigidly fixed to the inner wall, the stop member extending a predetermined distance into the axial bore to provide a rearwardly presented blocking surface, the second plate including an inner wall defining a bolt-receiving cup, and a bar lock mechanism positioned within the axial bore of the first plate for sliding movement therein toward a second plate-locking position, the bar lock mechanism including bolt means for entering the bolt-receiving cup formed in the second plate upon movement of the bar lock mechanism to its second plate-locking position and retaining means for selectively confining the stop member to limit sliding axial movement of the bar lock mechanism relative to the first plate in forward and rearward directions so that unauthorized removal of the bar lock mechanism from the axial bore is prevented, the lug means, bolt means, and retaining means cooperating to interlock the first and second plates, thereby preventing unauthorized separation thereof.

33. The bar lock system of claim 32, wherein the first plate includes a rearward portion extending between the stop member and the rearward opening, the rearward opening is formed to include a pin-receiving slot having an opening in the inner wall, and the retaining means includes pin means for lockably engaging the pin-receiving slot to retain the bar lock mechanism in at least one selected position within the axial bore.

34. The bar lock system of claim 33, wherein the bar lock mechanism includes an exterior side wall formed to include an aperture therein, the retaining means further includes a key-actuated rotatable key plug, and the pin means includes throw member means for engaging the key plug, support means for rotatably mounting the throw member means in the retaining means to rotate with the key plug, and a locking pin having a proximal end fixed to the throw member means and a distal end extending through the side wall aperture for engagement with the pin-receiving slot.

35. The bar lock system of claim 32, wherein the retaining means includes abutment means for engaging the rearwardly presented blocking surface of the stop means to prevent unauthorized removal of the bar lock mechanism from the axial bore through the forward opening.

36. The bar lock mechanism of claim 35, wherein the retaining means further includes locking means intermediate the abutment means and the bolt means for selectively retaining the bar lock mechanism in its second plate-locking position.

37. The bar lock system of claim 32, wherein the retaining means is configured to provide a core-receiving chamber and includes a lock core, a lock cap having an inner face, and means for mounting on the lock core, and the lock core includes control lug means for selectively retaining a portion of the lock core in the core-receiving chamber to position the inner face of the lock cap in spaced-apart confronting relation to the stop member so that the inner face of the lock cap engages the stop member during rearward movement of the bar lock mechanism in the axial bore to prevent unauthorized removal of the bar lock mechanism through the rearward opening.

* * * * *